US007077793B2

(12) United States Patent
Wu

(10) Patent No.: US 7,077,793 B2
(45) Date of Patent: Jul. 18, 2006

(54) PULL EXERCISER

(76) Inventor: Ying-Ching Wu, No. 32-2, Shin-Chi Village, An-Ding Shiang, Tainan-Hsien (TW)

( * ) Notice: Subject to any disclaimer, the term of this patent is extended or adjusted under 35 U.S.C. 154(b) by 356 days.

(21) Appl. No.: 10/743,657

(22) Filed: Dec. 22, 2003

(65) Prior Publication Data

US 2005/0137066 A1 Jun. 23, 2005

(51) Int. Cl.
*A63B 21/00* (2006.01)

(52) U.S. Cl. ..... 482/126; 482/121; 482/129

(58) Field of Classification Search ..... 482/121–130, 482/44, 49, 82, 123, 122, 139, 148, 904
See application file for complete search history.

(56) References Cited

U.S. PATENT DOCUMENTS 6,244,998 B1 * 6/2001 Hinds ..... 482/126
6,450,929 B1 * 9/2002 Markham ..... 482/121
6,524,226 B1 * 2/2003 Kushner ..... 482/126

* cited by examiner

*Primary Examiner*—Jerome Donnelly
(74) *Attorney, Agent, or Firm*—Alan D. Kamrath; Nikolai & Mersereaum P.A.

(57) ABSTRACT

A pull exerciser includes a handle, an attachment member having a tubular portion and a loop portion, a resilient cord having an end attached to the tubular portion of the attachment member, and a belt extending through a through-hole of the handle and the loop portion of the attachment member. The tubular portion of the attachment member has an engaging hole through which the end of the resilient cord extends. A stop is embedded in the end of the resilient cord and partially inserted into the engaging hole of the tubular portion of the attachment member, thereby preventing the end of the resilient cord from disengaging from the tubular portion of the attachment member.

13 Claims, 9 Drawing Sheets

PULL EXERCISER

BACKGROUND OF THE INVENTION

1. Field of the Invention

The present invention relates to a pull exerciser that has a simplified structure and that can be manufactured at a low cost.

2. Description of the Related Art

FIG. 1 of the drawings illustrates a conventional pull exerciser. The pull exerciser includes two handles 1, two belts 2, and a resilient cord 3. The respective belt 2 extends through a through-hole 11 of the respective handle 1. The two ends of the respective belt 2 are sewn together by sewing lines 21 to form an engaging section 22 with an engaging hole 23 for securely fixing an end of the respective cord 3 through use of an attachment member 4.

As illustrated in FIG. 2, the respective attachment member 4 includes a collar 41 and a washer 42. A cylindrical body 412 of the collar 41 extends through the engaging hole 23 of the respective belt 2. An annular extension 411 extends radially outward from an end of the cylindrical body 412 and abuts against an outer side of the engaging section 22. The washer 42 is mounted to an inner side of the engaging section 22. The other end of the cylindrical body 412 is processed to form an annular curled portion 413 to thereby fix the attachment member 4 to the engaging portion 22. An end of the resilient cord 3 is extended through the cylindrical body 412 of the collar 41, with a stop 31 being inserted into the end of the resilient cord 3. A tubular member 32 is mounted around the end of the resilient cord 3. An end of the tubular member 32 is securely sandwiched between the cylindrical body 412 of the collar 41 and a section of the cord 3 in the engaging hole 23 of the belt 2. The stop 31 prevents the end of the resilient cord 3 from passing through the engaging hole 23 of the belt 2, thereby preventing the resilient cord 3 from disengaging from the attachment member 4. The respective attachment member 4 is made of metal to provide sufficient strength for retaining the respective end of the resilient cord 3 in place. However, the procedure for fixing the respective end of the resilient cord 3 is troublesome and time-consuming. Further, the metal attachment 4 is apt to rust and be damaged while increasing the manufacturing cost for the pull exerciser.

SUMMARY OF THE INVENTION

An object of the present invention is to provide a pull exerciser that has a simplified structure and that can be manufactured at a low cost.

In accordance with an aspect of the invention, a pull exerciser includes a handle, an attachment member having a tubular portion and a loop portion, a resilient cord having an end attached to the tubular portion of the attachment member, and a belt extending through a through-hole of the handle and the loop portion of the attachment member.

The tubular portion of the attachment member has an engaging hole through which the end of the resilient cord extends. A stop is embedded in the end of the resilient cord and partially inserted into the engaging hole of the tubular portion of the attachment member, thereby preventing the end of the resilient cord from disengaging from the tubular portion of the attachment member.

A sleeve is mounted around the respective end of the resilient cord, with a section of the sleeve being securely sandwiched between the respective end of the resilient cord and an inner periphery delimiting the engaging hole of the tubular portion of the respective attachment member. The stop has a relatively smaller end distal to the end of the resilient cord and a relatively larger end adjacent to the end of the resilient cord. An overall diameter of the sleeve, the end of the resilient cord, and the relatively larger end of the stop is greater than an inner diameter of the engaging hole of the tubular portion of the attachment member. An overall diameter of the sleeve, the end of the resilient cord, and the relatively smaller end of the stop is smaller than the inner diameter of the engaging hole of the tubular portion of the attachment member.

Preferably, the sleeve is made of rubber, and the attachment member is made of a plastic material.

Preferably, the loop portion of the attachment member has a hole. Another attachment member is attached to the other end of the resilient cord. An engaging member has a first end releasably engaged with the hole of the loop portion of another attachment member and a second end to be engaged with a fixed object, such as a ring on a wall or the like. In an embodiment of the invention, the first end of the engaging member has a snapping member for releasably engaging with the hole of the loop portion of another said attachment member.

In accordance with another aspect of the invention, a pull exerciser includes two handles, two attachment members each including a tubular portion and a loop portion, a resilient cord having two ends respectively attached to the tubular portions of the attachment members, and two belts each extending through a through-hole of the respective handle and the loop portion of the respective attachment member.

The tubular portion of the respective attachment member has an engaging hole through which the respective end of the resilient cord extends. A stop is embedded in the respective end of the resilient cord and partially inserted into the engaging hole of the tubular portion of the respective attachment member, thereby preventing the respective end of the resilient cord from disengaging from the tubular portion of the respective attachment member.

A sleeve is mounted around the respective end of the resilient cord, with a section of the sleeve being securely sandwiched between the respective end of the resilient cord and an inner periphery delimiting the engaging hole of the tubular portion of the respective attachment member. The stop has a relatively smaller end distal to the respective end of the resilient cord and a relatively larger end adjacent to the respective end of the resilient cord. An overall diameter of the sleeve, the respective end of the resilient cord, and the relatively larger end of the stop is greater than an inner diameter of the engaging hole of the tubular portion of the respective attachment member. An overall diameter of the sleeve, the respective end of the resilient cord, and the relatively smaller end of the stop is smaller than the inner diameter of the engaging hole of the tubular portion of the respective attachment member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
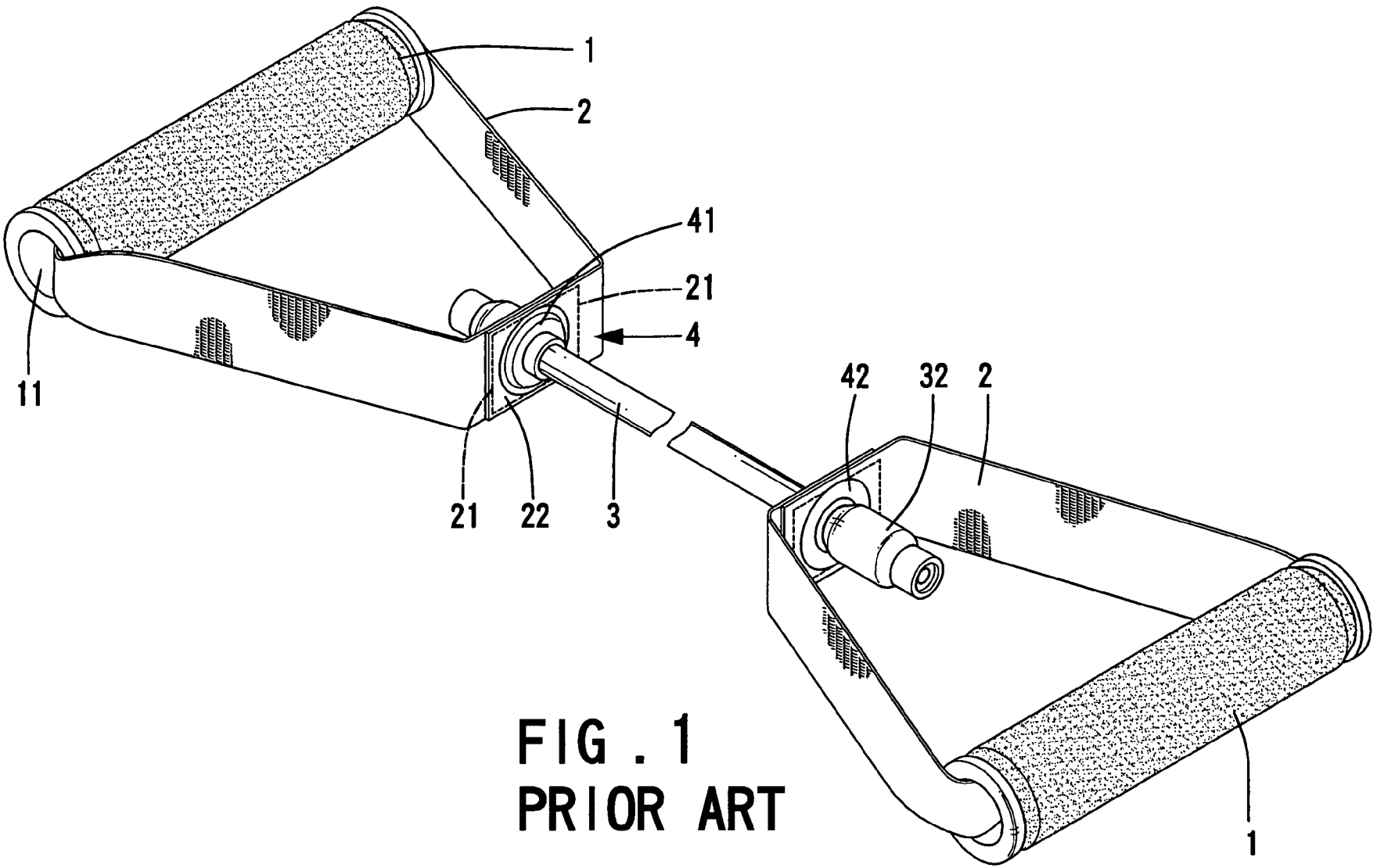
FIG. 1 PRIOR ART
FIG. 1 is a perspective view of a conventional pull exerciser.
Figure 2:
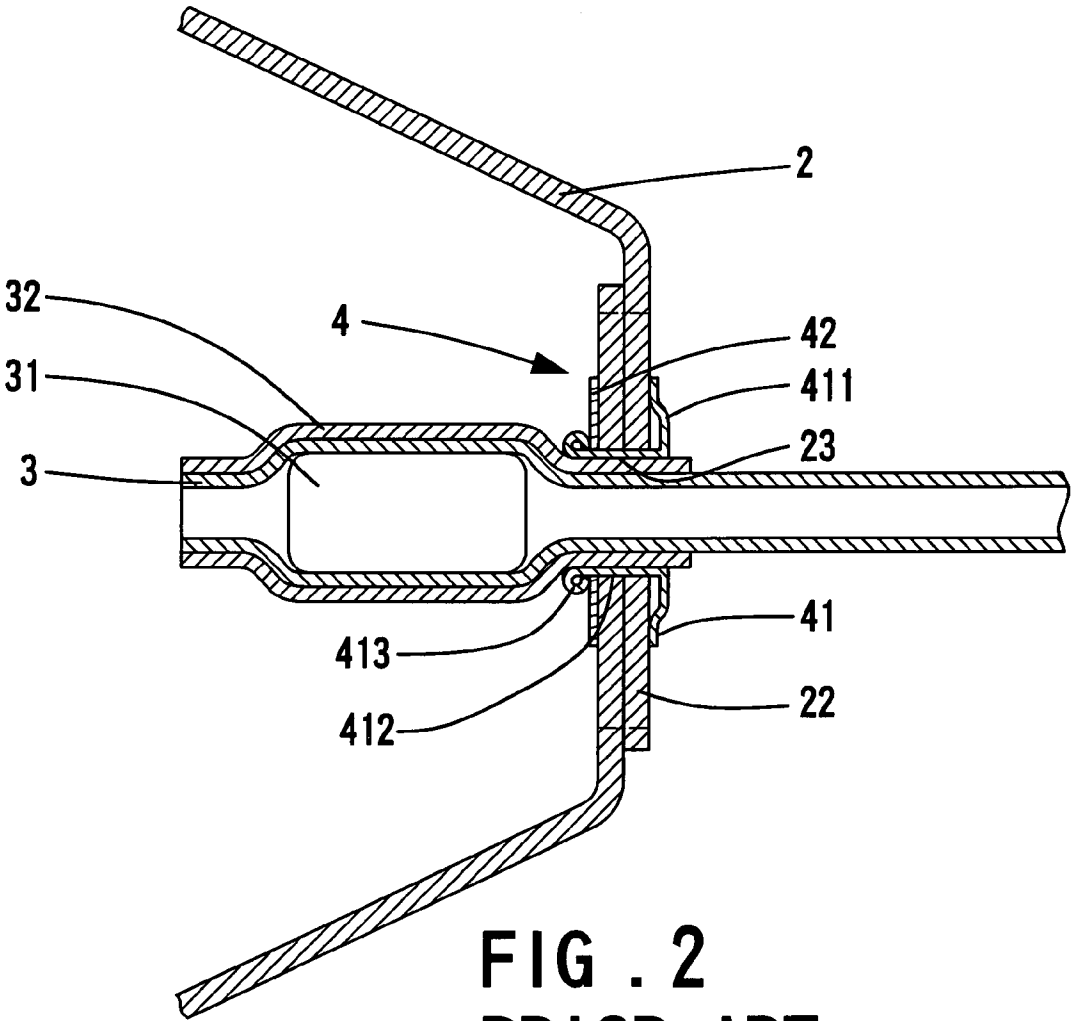
FIG. 2 PRIOR ART
FIG. 2 is an enlarged sectional view illustrating engagement of an end of a resilient cord and an attachment member of the conventional pull exerciser.
Figure 3:
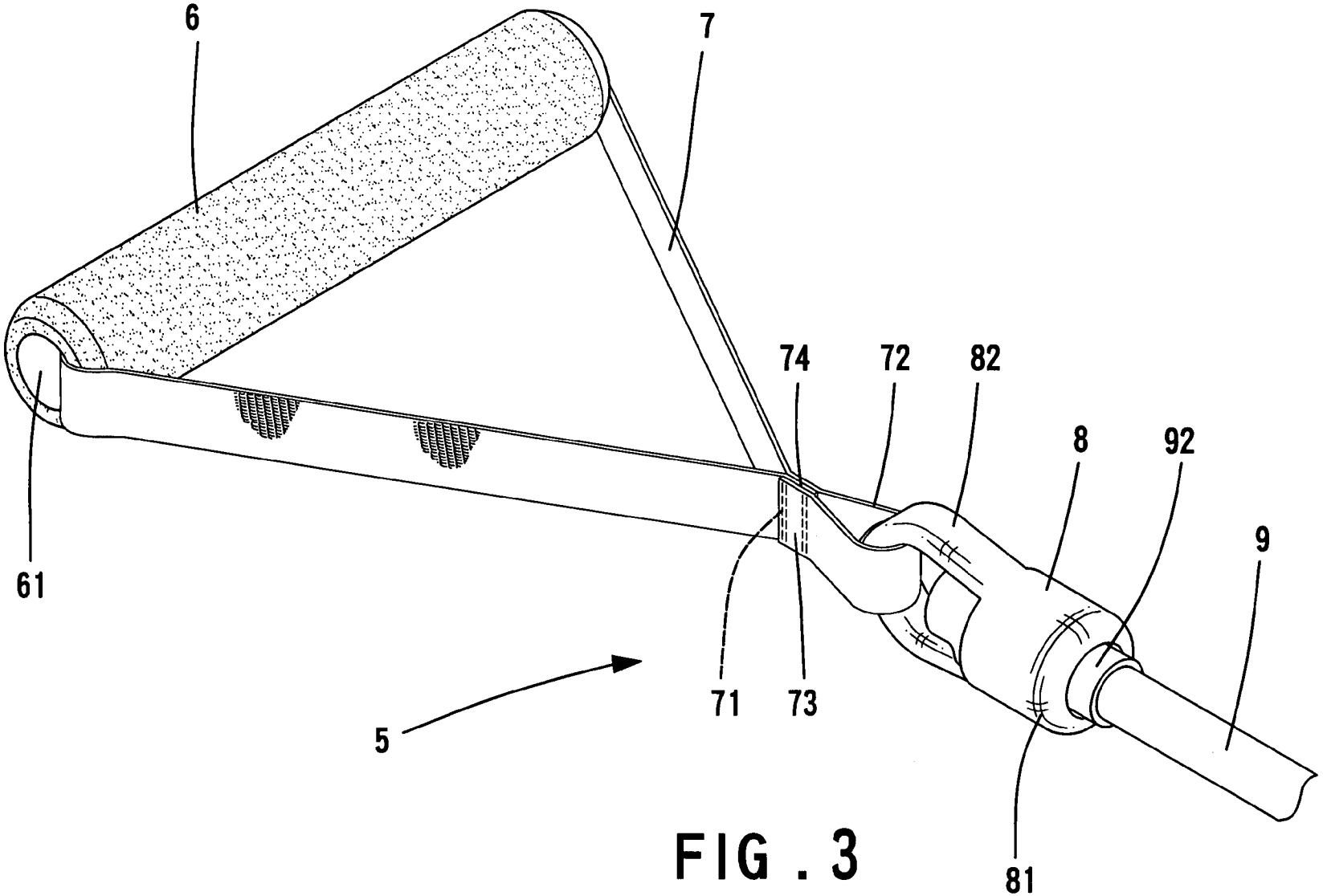
FIG. 3 is a perspective view of a portion of a pull exerciser in accordance with the present invention.
Figure 4:
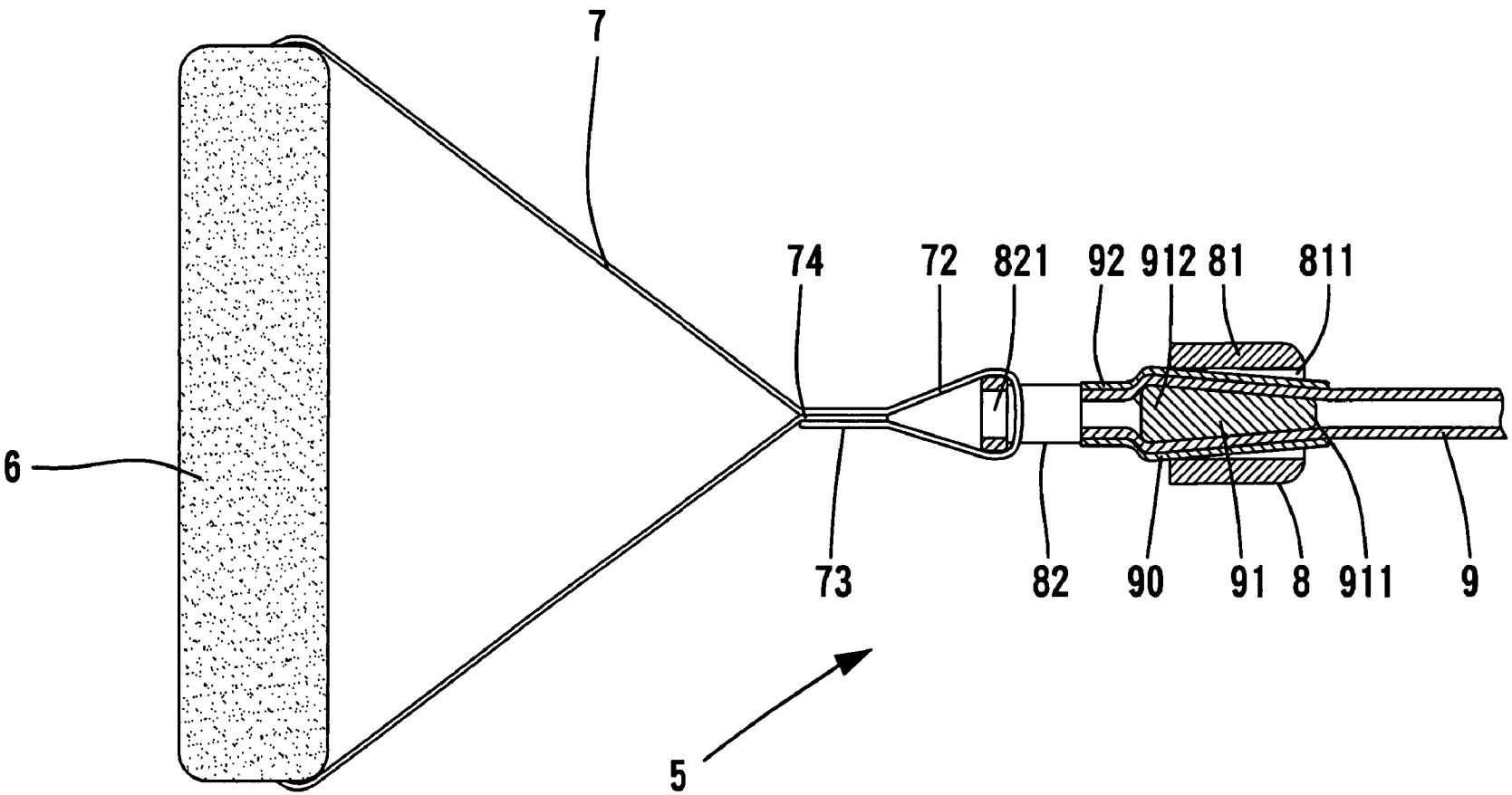
FIG. 4 is a sectional view of the portion of the pull exerciser in accordance with the present invention.
Figure 5:
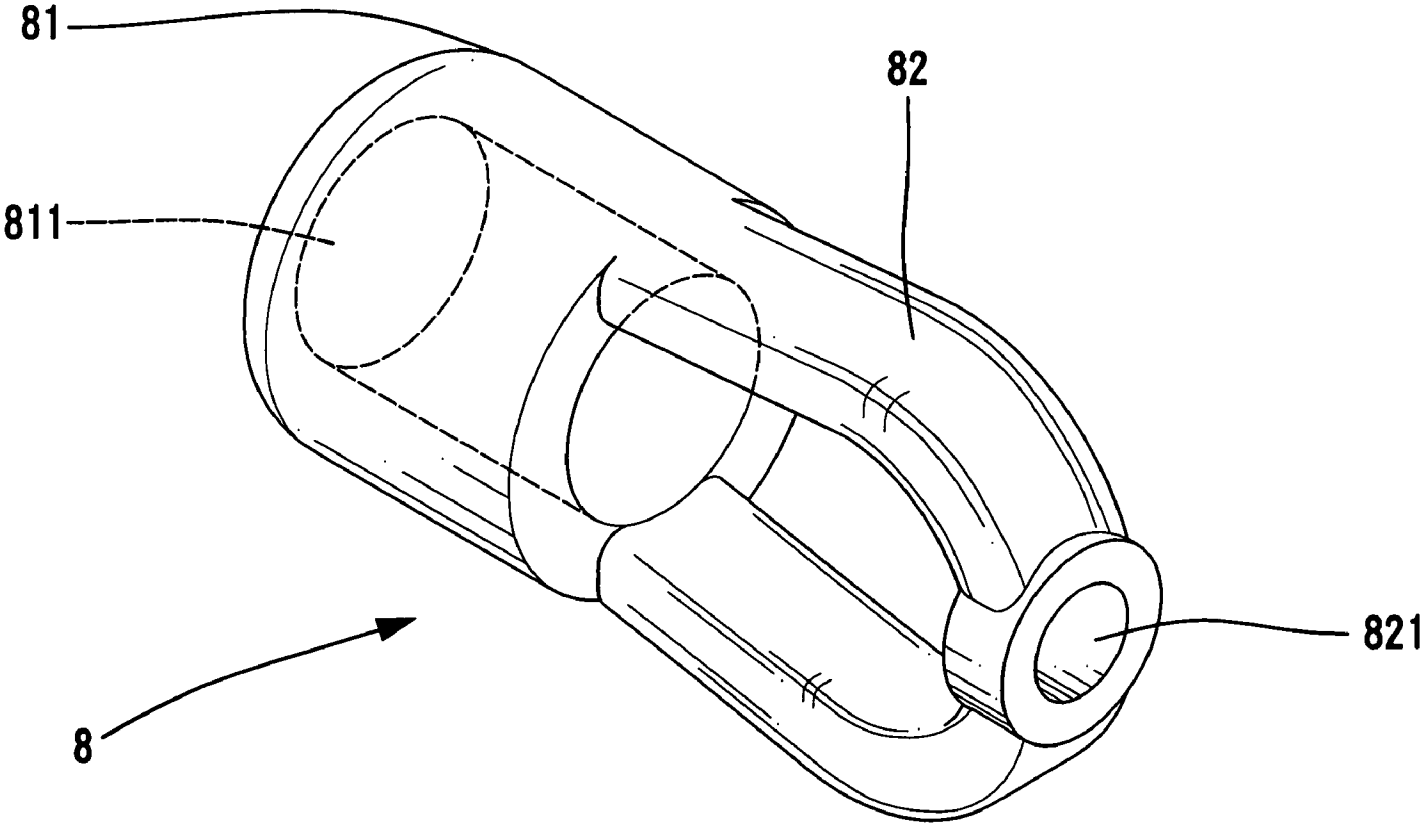
FIG. 5 is a perspective view, in an enlarged scale, of an attachment member of the pull exerciser in accordance with the present invention.

Referring to FIGS. 3 and 4, a pull exerciser 5 in accordance with the present invention generally includes a handle 6, a belt 7, an attachment member 8, and a resilient cord 9. As illustrated in FIG. 5, the attachment member 8 includes a tubular portion 81 on an end thereof and a loop portion 82 on the other end thereof. An engaging hole 811 is defined in the tubular portion 81 and preferably communicates with a space delimited by the loop portion 82. Preferably, the loop portion 82 has a hole 821, which will be described later. The attachment member 8 can be made of a plastic material by, e.g., injection molding and, thus, has a low cost.

The belt 7 is extended through the through-hole 61 of the handle 6 and the loop portion 82 of the attachment member 8. Two ends 73 and 74 of the belt 7 are then sewn together by sewing lines 71, forming a loop 72.

Referring to FIG. 4, an end 90 of the resilient cord 9 is extended through the engaging hole 811 of the tubular portion 81 of the attachment member 8 until a distal portion of the end 90 of the resilient cord 9 is located in the space delimited by the loop portion 82 of the attachment member 8. A stop 91 is inserted into the end 90 of the resilient cord 9 via the distal portion of the end 90 of the resilient cord 9. A sleeve 92 is mounted around the end 90 of the resilient cord 9. The end 90 of the resilient cord 9 having the stop 91 embedded therein and the sleeve 92 are then inserted into the engaging hole 811 of the tubular portion 81 of the attachment member 8. It is noted that the stop 91 includes a relatively smaller end 911 distal to the distal portion of the end 90 of the resilient cord 9 and a relatively larger end 912 adjacent to the distal portion of the end 90 of the resilient cord 9. It is further noted that the overall outer diameter of the relatively larger end 912 of the stop 91, the end 90 of the resilient cord 9, and the sleeve 92 is greater than an inner diameter of the engaging hole 811 of the attachment member 81. This prevents the end 90 of the resilient cord 9 from disengaging from the attachment member 8 when the user uses the pull exerciser 5 and applies a pulling force that would cause the attachment member 8 and the resilient cord 9 to move in opposite directions. This is because a section of the sleeve 92 is securely sandwiched between the end 90 of the resilient cord 9 and an inner periphery delimiting the engaging hole 811 of the attachment member 8. Nevertheless, the overall outer diameter of the relatively smaller end 911 of the stop 91, the end 90 of the resilient cord 9, and the sleeve 92 is smaller than an inner diameter of the engaging hole 811 of the attachment member 81. The resilient cord 9 and the sleeve 92 may be made of, e.g., rubber and, thus, have excellent stretchability.

Figure 6:
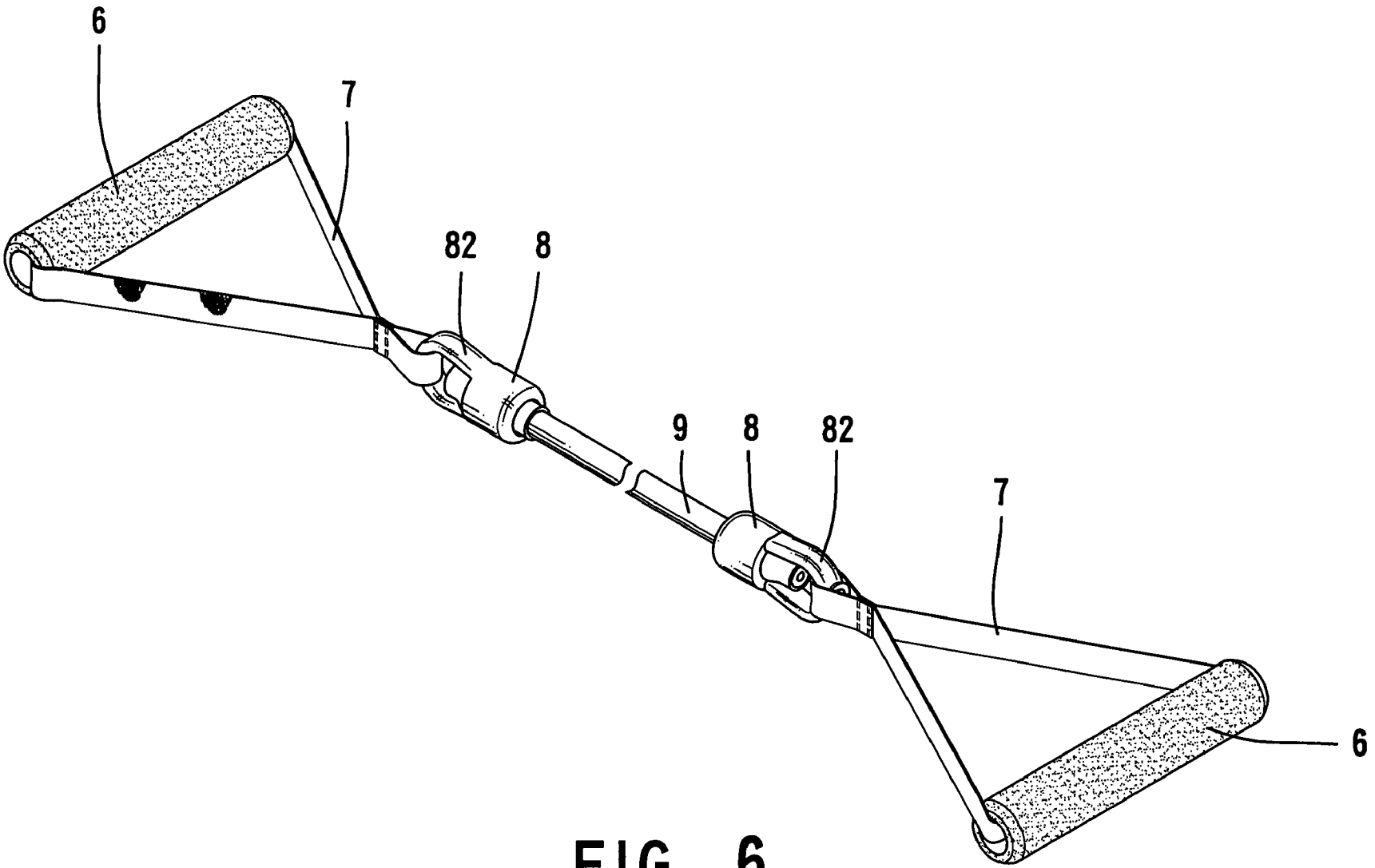
FIG. 6 is a perspective view of an exemplified embodiment of the pull exerciser in accordance with the present invention.
Figure 7:
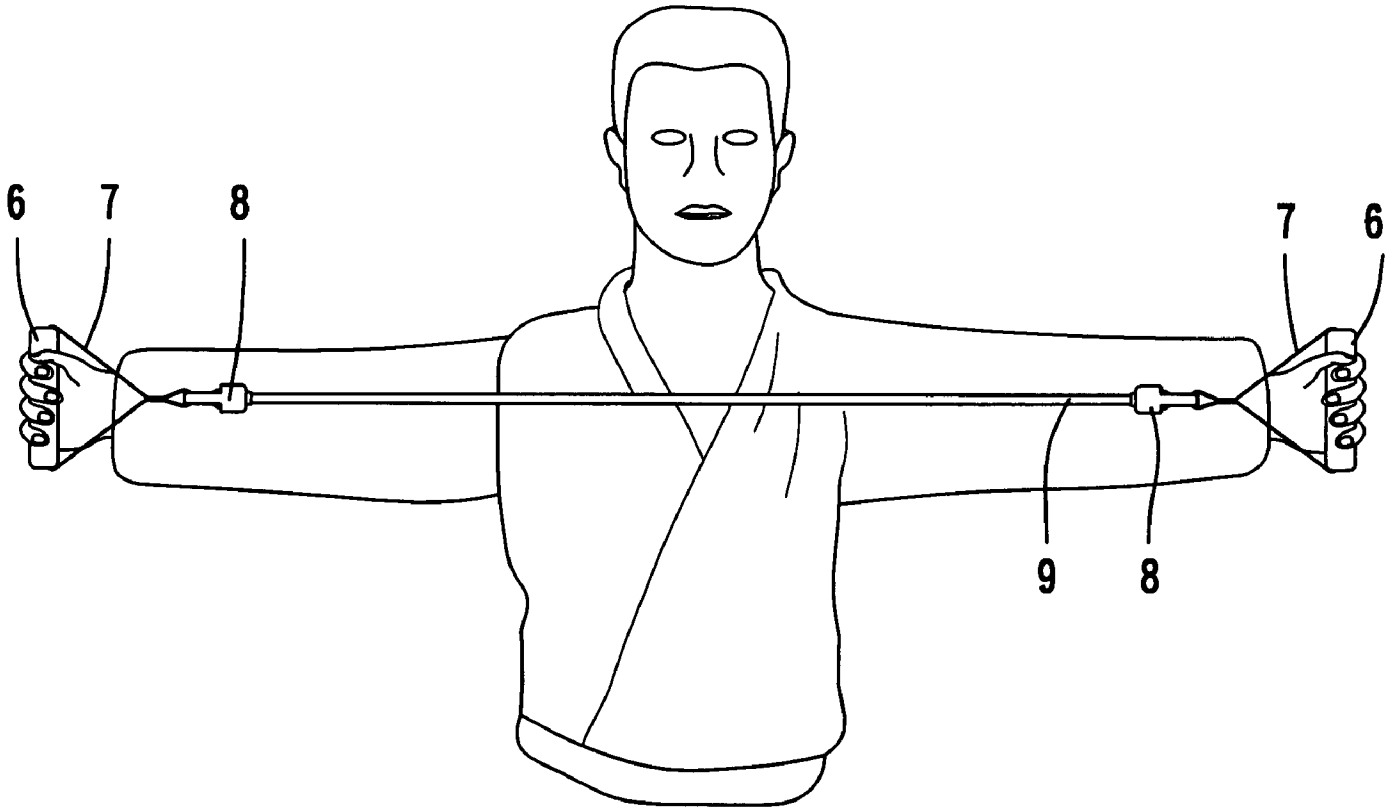
FIG. 7 is a schematic view illustrating use of the pull exerciser in FIG. 6.

FIG. 6 illustrates an exemplified embodiment of the pull exerciser. In this embodiment, the pull exerciser 5 includes two handles 6, two belts 7, two attachment members 8, and a resilient cord 9. Each end of the resilient cord 9 is securely attached to an associated attachment member 8 in a manner described above. The user may grip the handles 6 and pull the resilient cord 9 to achieve the exercising function, as shown in FIG. 7.

Figure 8:
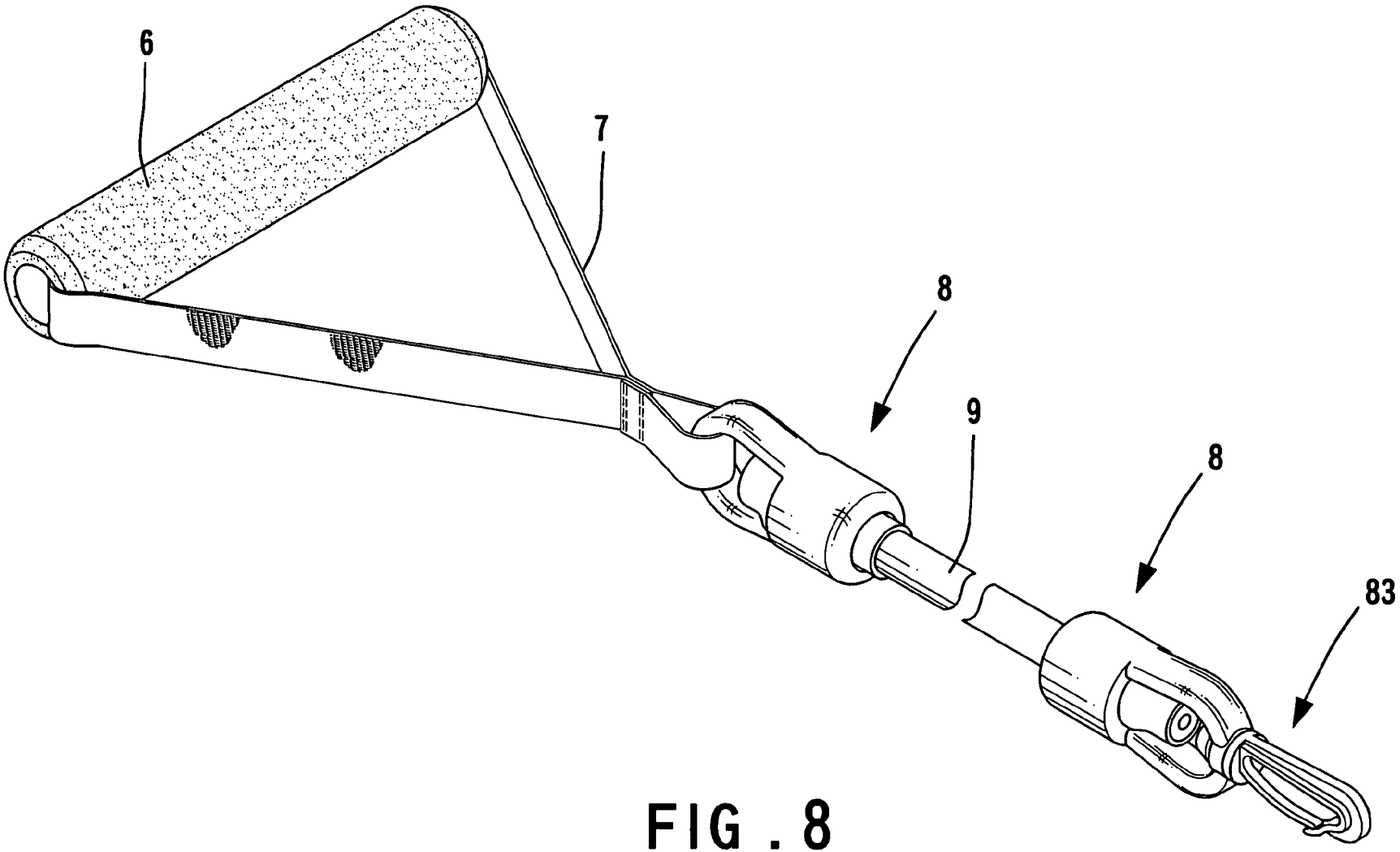
FIG. 8 is a perspective view of another exemplified embodiment of the pull exerciser in accordance with the present invention.
Figure 9:
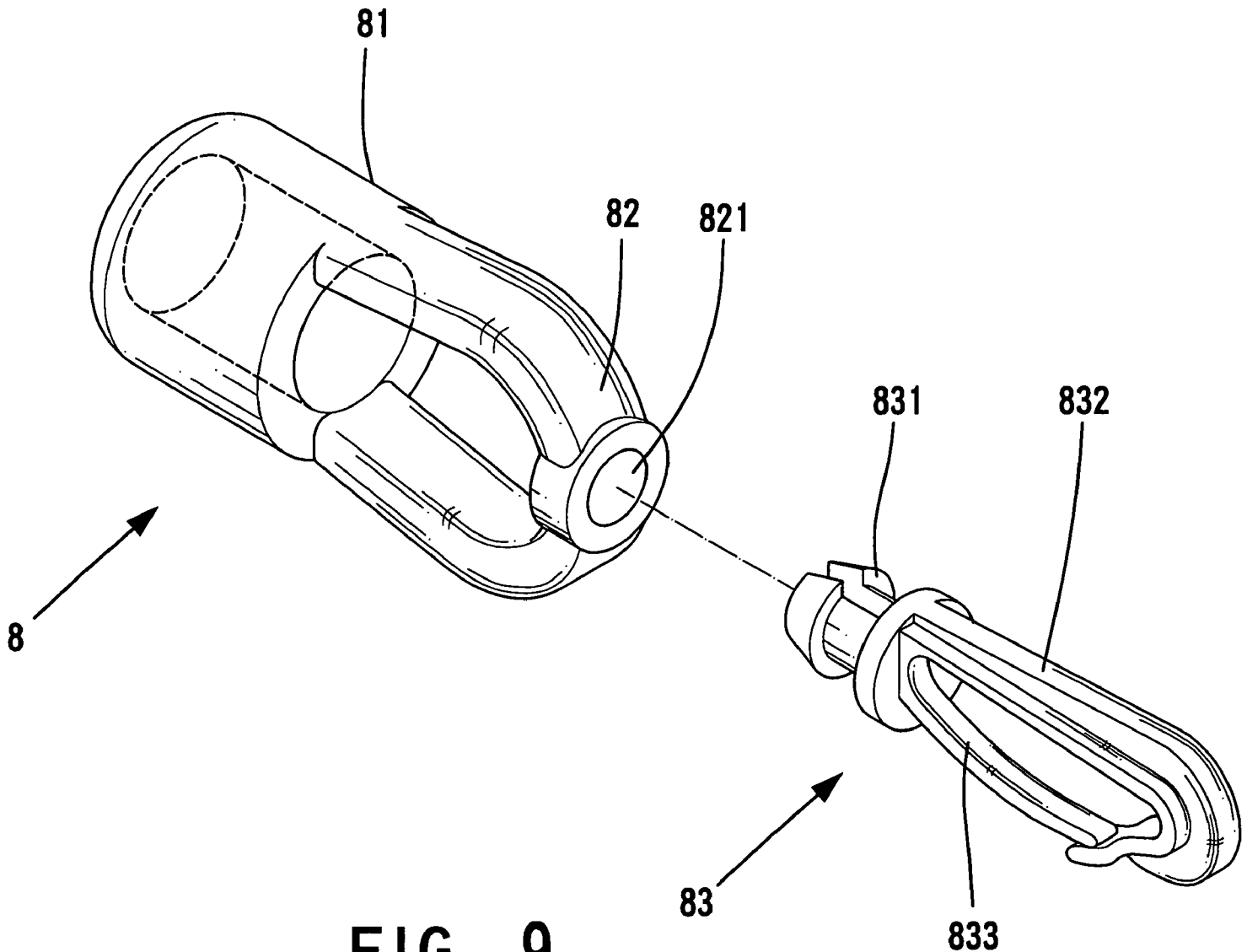
FIG. 9 is an exploded perspective view an attachment member and an engaging member used in the pull exerciser in FIG. 8.

FIG. 8 illustrates another exemplified embodiment of the pull exerciser. In this embodiment, the pull exerciser 5 includes a handle 6, a belt 7, two attachment members 8, a resilient cord 9, and an engaging member 83. As illustrated in FIG. 9, the engaging member 83 includes a snapping member 831 on an end thereof for releasably engaging with the hole 821 of the loop portion 82 of one of the attachment members 8. The attaching member 83 further includes a hook 832 and a resilient plate 833 on the other end thereof, allowing the attaching member 83 to be releasably engaged with, e.g., a ring (or a fixed object, not shown) fixed to a wall or the like. Thus, the user may use the pull exerciser having only one handle 6 with one or two hands.

Although the invention has been explained in relation to its preferred embodiments, it is to be understood that many other possible modifications and variations can be made without departing from the scope of the invention as hereinafter claimed.

What is claimed is:

1. A pull exerciser comprising:

a handle having a through-hole;

an attachment member including a tubular portion and a loop portion;

a resilient cord having an end attached to the tubular portion of the attachment member; and a belt extending through the through-hole of the handle and the loop portion of the attachment member;

the tubular portion of the attachment member having an engaging hole through which the end of the resilient cord extends, with a stop being embedded in the end of the resilient cord and partially inserted into the engaging hole of the tubular portion of the attachment member, thereby preventing the end of the resilient cord from disengaging from the tubular portion of the attachment member, the engaging hole of the tubular portion of the attachment member being delimited by an inner periphery;

further including a sleeve mounted around the end of the resilient cord, with a section of the sleeve being securely sandwiched between the end of the resilient cord and the inner periphery that delimits the engaging hole of the tubular portion of the attachment member.

2. The pull exerciser as claimed in claim 1, with the stop having a relatively smaller end distal to the end of the resilient cord and a relatively larger end adjacent to the end of the resilient cord, with an overall diameter of the sleeve, the end of the resilient cord, and the relatively larger end of the stop being greater than an inner diameter of the engaging hole of the tubular portion of the attachment member.

3. The pull exerciser as claimed in claim 2, with an overall diameter of the sleeve, the end of the resilient cord, and the relatively smaller end of the stop being smaller than the inner diameter of the engaging hole of the tubular portion of the attachment member.

4. The pull exerciser as claimed in claim 1, with the sleeve being made of rubber.

5. The pull exerciser as claimed in claim 1, with the attachment member being made of a plastic material.

6. The pull exerciser as claimed in claim 1, with the loop portion of the attachment member including a hole.

7. The pull exerciser as claimed in claim 6, with another said attachment member being attached to another end of the resilient cord, with an engaging member having a first end releasably engaged with the hole of the loop portion of another said attachment member and a second end adapted to be engaged with a fixed object.

8. The pull exerciser as claimed in claim 7, with the first end of the engaging member having a snapping member for releasably engaging with the hole of the loop portion of another said attachment member.

9. A pull exerciser comprising:

two handles each having a through-hole;

two attachment members each including a tubular portion and a loop portion;

a resilient cord having two ends respectively attached to the tubular portions of the attachment members; and two belts each extending through the through-hole of the respective handle and the loop portion of the respective attachment member;

with the tubular portion of the respective attachment member having an engaging hole through which the respective end of the resilient cord extends, with a stop being embedded in the respective end of the resilient cord and partially inserted into the engaging hole of the tubular portion of the respective attachment member, thereby preventing the respective end of the resilient cord from disengaging from the tubular portion of the respective attachment member, the engaging hole of the tubular portion of the attachment member being delimited by an inner periphery;

further including a sleeve mounted around the respective end of the resilient cord, with a section of the sleeve being securely sandwiched between the respective end of the resilient cord and the inner periphery that delimits the engaging hole of the tubular portion of the respective attachment member.

10. The pull exerciser as claimed in claim 9, with the stop having a relatively smaller end distal to the respective end of the resilient cord and a relatively larger end adjacent to the respective end of the resilient cord, with an overall diameter of the sleeve, the respective end of the resilient cord, and the relatively larger end of the stop being greater than an inner diameter of the engaging hole of the tubular portion of the respective attachment member.

11. The pull exerciser as claimed in claim 10, with an overall diameter of the sleeve, the respective end of the resilient cord, and the relatively smaller end of the stop being smaller than the inner diameter of the engaging hole of the tubular portion of the respective attachment member.

12. The pull exerciser as claimed in claim 9, with the sleeve being made of rubber.

13. The pull exerciser as claimed in claim 9, with the respective attachment member being made of a plastic material.

* * * * *